US009596963B2

(12) United States Patent
Harris et al.

(10) Patent No.: US 9,596,963 B2
(45) Date of Patent: Mar. 21, 2017

(54) VENTED REFILL UNITS AND DISPENSERS HAVING VENTED REFILL UNITS

(71) Applicant: GOJO Industries, Inc., Akron, OH (US)

(72) Inventors: Donald R. Harris, Tallmadge, OH (US); Aaron D. Marshall, Cuyahoga Falls, OH (US); Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 20 days.

(21) Appl. No.: 14/811,995

(22) Filed: Jul. 29, 2015

(65) Prior Publication Data

US 2016/0029855 A1 Feb. 4, 2016

Related U.S. Application Data

(60) Provisional application No. 62/030,806, filed on Jul. 30, 2014.

(51) Int. Cl.
*A47K 5/14* (2006.01)
*B05B 11/00* (2006.01)
(Continued)

(52) U.S. Cl.
CPC ..... *A47K 5/14* (2013.01); *A47K 13/26* (2013.01); *B05B 11/0018* (2013.01);
(Continued)

(58) Field of Classification Search
CPC ..... A47K 5/14; A47K 13/26; A47K 5/1207; B05B 11/0018; B05B 11/3047; B05B 11/3087; B05B 7/0037
(Continued)

(56) References Cited

U.S. PATENT DOCUMENTS 585,327 A 6/1897 Guttenberg
922,453 A 5/1909 Burgner
(Continued)

FOREIGN PATENT DOCUMENTS

CH 676227 12/1990
DE 102008034244 3/2010
(Continued)

OTHER PUBLICATIONS

Office Action from U.S. Appl. No. 14/327,975 dated May 7, 2015.
(Continued)

*Primary Examiner* — Donnell Long
(74) *Attorney, Agent, or Firm* — Calfee, Halter & Griswold LLP

(57) ABSTRACT

Exemplary embodiments of vented refill units and dispensers having vented refill units are disclosed herein. An exemplary refill unit includes a non-collapsing inverted container. The container has a neck located at the bottom of the container. A pump is secured to the neck. The pump has a housing that has a cylindrical outside surface. In addition, the housing has an attachment mechanism for attaching the pump to a venting insert. The venting insert has a cylindrical inside surface and a cylindrical outside surface. At least a portion of the venting insert is located within the neck. An air passage is located between the pump housing and the cylindrical inside surface of the venting insert. One or more apertures are located through the venting insert. A one-way air inlet valve is located proximate the one or more apertures.

21 Claims, 6 Drawing Sheets

(51) Int. Cl.
*A47K 13/26* (2006.01)
*A47K 5/12* (2006.01)
*B05B 7/00* (2006.01)

(52) U.S. Cl.
CPC ..... *B05B 11/3047* (2013.01); *A47K 5/1207* (2013.01); *B05B 7/0037* (2013.01); *B05B 11/3087* (2013.01)

(58) Field of Classification Search
USPC ..... 222/481.5, 190
See application file for complete search history.

(56) References Cited

U.S. PATENT DOCUMENTS 1,167,420 A 1/1916 Marcuse
1,207,278 A 12/1916 Cordley
1,207,505 A 12/1916 Cordley
1,220,753 A 3/1917 Kees
1,303,708 A 5/1919 Moffitt
1,553,113 A 9/1935 Amos
2,464,030 A 3/1949 Engstrom
2,529,365 A 11/1950 Barksdale
2,605,021 A 7/1952 Spencer et al.
2,770,234 A 11/1956 Nesset et al.
2,904,222 A 9/1959 Philippe
3,200,994 A 8/1965 Levinson et al.
3,215,319 A 11/1965 Laker
3,239,151 A 3/1966 Boris-Nee Jokelson
3,361,078 A 1/1968 Cooprider
3,628,704 A 12/1971 Corsette
3,674,181 A 7/1972 Marks et al.
3,790,034 A 2/1974 Horvath
3,851,801 A 12/1974 Roth
4,057,176 A 11/1977 Horvath
4,142,653 A 3/1979 Mascla et al.
4,168,020 A 9/1979 Benson
4,183,449 A 1/1980 Blake
4,249,676 A 2/1981 Beery
4,272,019 A 6/1981 Halaby, Jr.
4,321,938 A 3/1982 Siller
4,330,071 A 5/1982 Ohlson
4,360,130 A 11/1982 Nishimura et al.
4,410,107 A 10/1983 Corsette
4,493,440 A 1/1985 von Buelow et al.
4,646,945 A 3/1987 Steiner
4,694,976 A 9/1987 Schuetz
4,793,522 A 12/1988 Corsette
4,798,311 A 1/1989 Workum
4,880,161 A 11/1989 Wright
4,930,667 A 6/1990 Holzner, Sr.
4,932,561 A 6/1990 Boxall
4,986,453 A 1/1991 Lina et al.
4,997,429 A 3/1991 Dickerhoff et al.
5,033,654 A 7/1991 Bennett
5,037,006 A 8/1991 Kock
5,082,150 A 1/1992 Steiner et al.
5,110,052 A 5/1992 Graf et al.
5,238,187 A 8/1993 Ziotnik et al.
5,271,530 A 12/1993 Uehira et al.
5,282,552 A 2/1994 Ophardt
5,310,094 A 5/1994 Martinez et al.
5,439,140 A 8/1995 Meyer
5,443,569 A 8/1995 Uehira et al.
5,445,288 A 8/1995 Banks
5,462,208 A 10/1995 Stahley et al.
5,489,044 A 2/1996 Ophardt
5,503,306 A 4/1996 Knickerbocker
5,507,417 A 4/1996 Webb
5,549,224 A 8/1996 Wu
5,727,715 A 3/1998 McKenna et al.
5,752,627 A 5/1998 Vandromme et al.
5,826,755 A 10/1998 Burd
5,862,954 A 1/1999 Ehrensperger et al.
5,899,363 A 5/1999 Bliss, III et al.
5,906,299 A 5/1999 Hagleitner
5,927,559 A 7/1999 Bommer et al.
6,016,936 A 1/2000 Fan
6,053,364 A 4/2000 van der Heijden
6,065,647 A 5/2000 Bliss, III et al.
6,082,586 A 7/2000 Banks
6,244,472 B1 6/2001 Hennermann
6,378,742 B1 4/2002 Rohr et al.
6,386,403 B2 5/2002 Parsons et al.
6,446,840 B2 9/2002 Ophardt et al.
6,540,111 B2 4/2003 Sunnarorg
6,669,060 B2 12/2003 DeLaforcade
6,688,499 B2 2/2004 Zhang
6,921,004 B1 7/2005 Knickerbocker
6,971,549 B2 12/2005 Leifheit et al.
6,986,443 B2 1/2006 Laible
7,004,356 B1 2/2006 Sayers
7,021,494 B2 4/2006 Mazooji et al.
7,040,511 B1 5/2006 Petit
7,059,282 B2 6/2006 Vorih et al.
7,303,098 B2 12/2007 Backes
7,308,990 B2 12/2007 Mazooji et al.
7,337,930 B2 3/2008 Ophardt et al.
7,377,758 B2 5/2008 Sallows et al.
7,461,762 B2 12/2008 Law et al.
7,641,077 B2 1/2010 Law et al.
7,708,166 B2 5/2010 Ophardt
7,806,301 B1 10/2010 Ciavarella et al.
7,815,076 B2 10/2010 Ophardt
7,938,297 B2 5/2011 Law et al.
8,002,150 B2 8/2011 Ophardt et al.
8,047,403 B2 11/2011 Quinlan et al.
8,047,404 B2 11/2011 Quinlan et al.
8,272,539 B2 9/2012 Ophardt et al.
8,474,664 B2 7/2013 Ophardt et al.
8,523,024 B2 9/2013 Piscopo et al.
8,579,159 B2 11/2013 Ciavarella
8,596,501 B2 12/2013 Hagleitner
8,602,263 B2 12/2013 Baron et al.
8,662,356 B2 3/2014 Padain et al.
8,733,588 B2 5/2014 Ophardt et al.
2002/0153389 A1 10/2002 Creaghan et al.
2002/0179735 A1 12/2002 Santaguilina
2003/0000967 A1 1/2003 Ehrensperger et al.
2004/0031816 A1 2/2004 Schuman et al.
2005/0109798 A1 5/2005 Kasting
2005/0205600 A1 9/2005 Ophardt et al.
2005/0224519 A1* 10/2005 Law ..... B05B 7/0025 222/190
2005/0284887 A1 12/2005 Lewis et al.
2006/0032871 A1 2/2006 Ophardt
2006/0076364 A1 4/2006 Stark
2006/0273114 A1 12/2006 Ophardt
2006/0278657 A1 12/2006 Roatis
2007/0023454 A1 2/2007 Ophardt
2008/0035223 A1 2/2008 Ritsche
2008/0141635 A1 6/2008 Clerget
2008/0149666 A1 6/2008 LaFamme et al.
2008/0272148 A1 11/2008 Malik et al.
2009/0001100 A1 1/2009 van der Heijden
2009/0188944 A1 7/2009 Ciavarella et al.
2009/0200338 A1 8/2009 Quinlan et al.
2009/0308894 A1 12/2009 Ophardt et al.
2010/0096412 A1 4/2010 Law
2011/0014076 A1 1/2011 Shi et al.
2011/0031278 A1 2/2011 Hande Man
2011/0079614 A1 4/2011 Ganzeboom et al.
2011/0089198 A1 4/2011 Leuliet
2011/0139825 A1 6/2011 Houghton
2011/0174840 A1 7/2011 Law et al.
2012/0067923 A1 3/2012 Matthews et al.
2012/0074171 A1 3/2012 Quinlan et al.
2013/0315031 A1 11/2013 Bunoz et al.
2014/0034679 A1 2/2014 Fitzpatrick
2014/0061245 A1 3/2014 McNulty et al.

(56) References Cited

U.S. PATENT DOCUMENTS

| | | | | |
|---|---|---|---|---|
| 2014/0203047 | A1 | 7/2014 | McNulty | |
| 2015/0102061 | A1* | 4/2015 | Larson | B05B 11/0081 222/129 |

FOREIGN PATENT DOCUMENTS

| | | |
|---|---|---|
| DE | 102011107376 | 1/2013 |
| EP | 0613728 | 1/1994 |
| EP | 1147818 | 10/2001 |
| EP | 2080464 | 7/2009 |
| EP | 2080560 | 7/2009 |
| FR | 2199588 | 4/1974 |
| GB | 1269545 | 4/1972 |
| GB | 2301812 | 12/1996 |
| GB | 2472235 | 2/2011 |
| WO | 98/18563 | 5/1998 |
| WO | 2006075196 | 7/2006 |
| WO | 2011157975 | 12/2011 |

OTHER PUBLICATIONS

European Patent Office Search Report issued Jan. 7, 2011 in EP Application No. 09 150 882.2; 4 pages.
Office Action from U.S. Appl. No. 14/628,478 dated Jan. 20, 2016.
Office Action from U.S. Appl. No. 14/484,328 dated Feb. 1, 2016.
Office Action from U.S. Appl. No. 14/327,975 dated Feb. 12, 2016.

* cited by examiner

VENTED REFILL UNITS AND DISPENSERS HAVING VENTED REFILL UNITS

RELATED APPLICATIONS

This application claims priority to and the benefits of U.S. Provisional Patent Application Ser. No. 62/030,806 filed on Jul. 30, 2014 and entitled "VENTED REFILL UNITS AND DISPENSERS HAVING VENTED REFILL UNITS," which is incorporated herein by reference in its entirety.

TECHNICAL FIELD

The present invention relates generally to liquid dispenser systems and more particularly to air-vented liquid dispensers, and refill units for use with such dispensers.

BACKGROUND OF THE INVENTION

Liquid dispenser systems, such as liquid soap and sanitizer dispensers, provide a user with an amount of liquid upon actuation of the dispenser. It is desirable to provide such a dispenser having a rigid container that is vented with air so that the pump may re-prime itself after a dispensing action. It is also desirable to provide such a dispenser that is easily recharged once the container runs out of liquid to dispense, and that is inexpensive to produce. Many prior art venting systems for containers leak when placed in an inverted position wherein the container of liquid is located above the pump. In addition, many prior art venting systems also leak when they are intermittently exposed to liquid. Further, over tightening of the pump to the container may cause the container to leak, or seal venting passages preventing the container from venting properly.

SUMMARY

Exemplary embodiments of vented refill units and dispensers having vented refill units are disclosed herein. An exemplary refill unit for a soap, sanitizer or lotion includes a non-collapsing inverted container. The non-collapsing inverted container has a neck located at the bottom of the container. A pump is secured to the neck. The pump has a housing that has a cylindrical outside surface. In addition, the housing has an attachment mechanism for attaching the pump to a venting insert. The venting insert has a cylindrical inside surface and a cylindrical outside surface. At least a portion of the venting insert is located within the neck. An air passage is located between the pump housing and the cylindrical inside surface of the venting insert. One or more apertures are located through the venting insert. A one-way air inlet valve is located proximate the one or more apertures and the one-way air inlet valve opens when the vacuum pressure in the container exceeds the cracking pressure of the one-way air inlet valve to allow air to vent the container.

Another exemplary refill unit for a soap, sanitizer or lotion includes a non-collapsing container. The non-collapsing has a neck located at the bottom of the container. A foam pump is secured to the neck. The foam pump has a housing. The housing has a cylindrical inside surface and a cylindrical outside surface. An air piston is movable back and forth within in the housing. A sealing member of the air piston is in contact with the cylindrical inside surface. A venting insert is included, the venting insert has an inside cylindrical surface and an outside cylindrical surface. The outside cylindrical surface of the venting insert is located at least partially within the neck. At least a portion of the outside cylindrical surface of the housing extends along at least a portion of the cylindrical inside surface of the venting insert. An air passage is located between the cylindrical outside surface of the housing and the cylindrical inside surface of the venting insert. An aperture is located through the venting insert to allow air to pass from a first side of the venting insert to the inside of the non-collapsing container. A one-way valve located proximate the aperture is also included.

Another exemplary refill unit for a soap, sanitizer or lotion includes a non-collapsing container. The non-collapsing container has a neck located at the bottom of the container. A pump having a liquid pump chamber and an air pump chamber is included. The air pump chamber has an outside cylindrical surface. A venting insert having an inside surface and an outside surface is included. The venting insert is located at least partially within the neck of the container. An air passage is located between the outside cylindrical surface of the housing and the inside surface of the venting insert. An air venting chamber is located above the air pump chamber and is in fluid communication with the air passage. An aperture is located at least partially above the air venting chamber. The aperture extends through the venting insert placing the air venting chamber in fluid communication with the inside of the non-collapsing container. In addition, a one-way valve located proximate the aperture for allowing air into the container and preventing liquid from flowing out of the container is also included.

In this way, a simple and economical refill unit with a container vent is provided. The venting insert may be used with "off-the shelf" non vented pumps.

BRIEF DESCRIPTION OF THE DRAWINGS

These and other features and advantages of the present invention will become better understood with regard to the following description and accompanying drawings in which.

DETAILED DESCRIPTION

Figure 1:
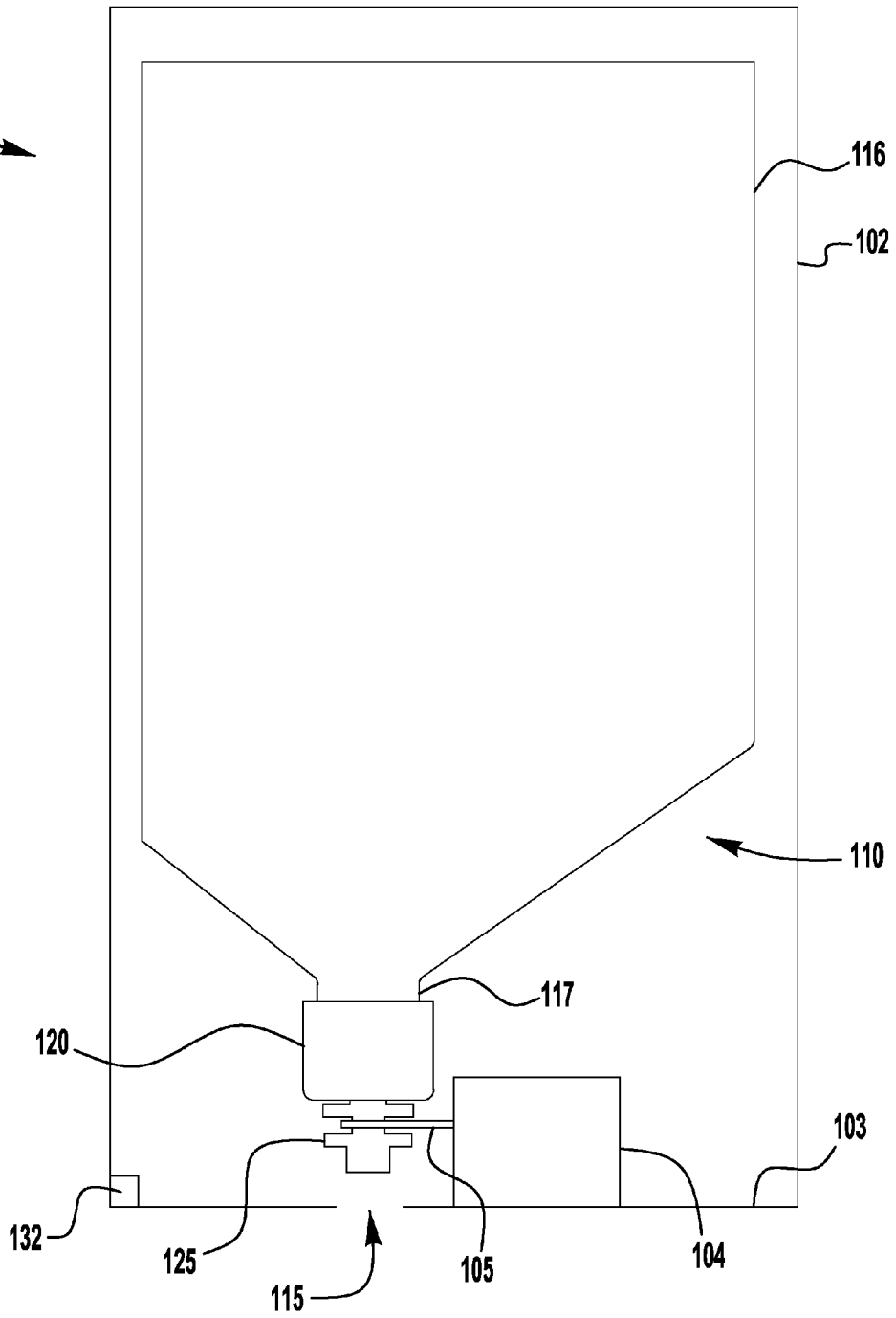
FIG. 1 is a cross-section of an exemplary liquid dispenser having a refill unit with a vertical pump.

FIG. 1 illustrates an exemplary embodiment of a dispenser 100 with a vertically operated pump 120. (The cross-section of FIG. 1 is taken through the housing 102 to show the pump 120 and container 116). Dispenser 100 includes a disposable refill unit 110. The disposable refill unit 110 includes a container 116 having a neck 117 connected to pump 120. The dispenser 100 may be a wall-mounted system, a counter-mounted system, an un-mounted portable system movable from place to place or any other kind of liquid dispenser system. In this particular embodiment, dispenser 100 is a foam dispenser; however, the inventive venting system disclosed herein may be used in liquid dispenser systems or foam dispenser systems. In addition, although embodiments contain vertically actuated pumps, the inventive system works equally well with other types of pumps, such as, for example, horizontally actuated pumps.

The container 116 forms a liquid reservoir that contains a supply of foamable liquid within the disposable refill unit 110. In various embodiments, the contained liquid could be, for example, a soap, a sanitizer, a cleanser, a disinfectant, a lotion or the like. In the exemplary disposable refill unit 110, the container 116 is a non-collapsing container and can be made of thin plastic or like material. The container 116 may advantageously be refillable, replaceable or both refillable and replaceable. In some embodiments, the liquids may be non-foamable or non-foaming liquids.

In the event the liquid stored in the container 116 of the installed disposable refill unit 110 runs out or the installed refill unit 110 otherwise has a failure, the installed refill unit 110 may be removed from the foam dispenser 100. The empty or failed disposable refill unit 110 may then be replaced with a new disposable refill unit 110.

The housing 102 of the dispenser 100 contains one or more actuating members 104 to activate the pump 120. As used herein, actuator or actuating members or mechanisms include one or more parts that cause the dispenser 100 to move liquid, air and/or foam. Actuator 104 is generically illustrated because there are many different kinds of pump actuators which may be employed in the foam dispenser 100. The actuator 104 of the foam dispenser 100 may be any type of actuator such as, for example, a manual lever, a manual pull bar, a manual push bar, a manual rotatable crank, an electrically activated actuator or other means for actuating the pump 120. Electronic actuators may additionally include a sensor 132 for detecting the presence of an object and to provide for a hands-free dispenser system with touchless operation. Various intermediate linkages, such as for example linkage 105, connects the actuator member 104 to the pump 120 within the system housing 102. An aperture 115 is located in bottom plate 103 of housing 102 and allows fluid dispensed from the nozzle 125 of pump 120 to be dispensed to a user.

Exemplary foam pumps are disclosed in U.S. Pat. No. 8,272,539 filed on Dec. 3, 2008 and entitled Angled Slot Foam Dispenser, which is incorporated herein by reference in its entirety. In some embodiments, pump 120 is a liquid pump. An exemplary liquid pump is disclosed in U.S. Pat. No. 8,002,150 filed on Jul. 30, 2007 and entitled Split Engagement Flange For Soap Dispenser Pump Piston, which is incorporated herein by reference in its entirety.

Figure 2:
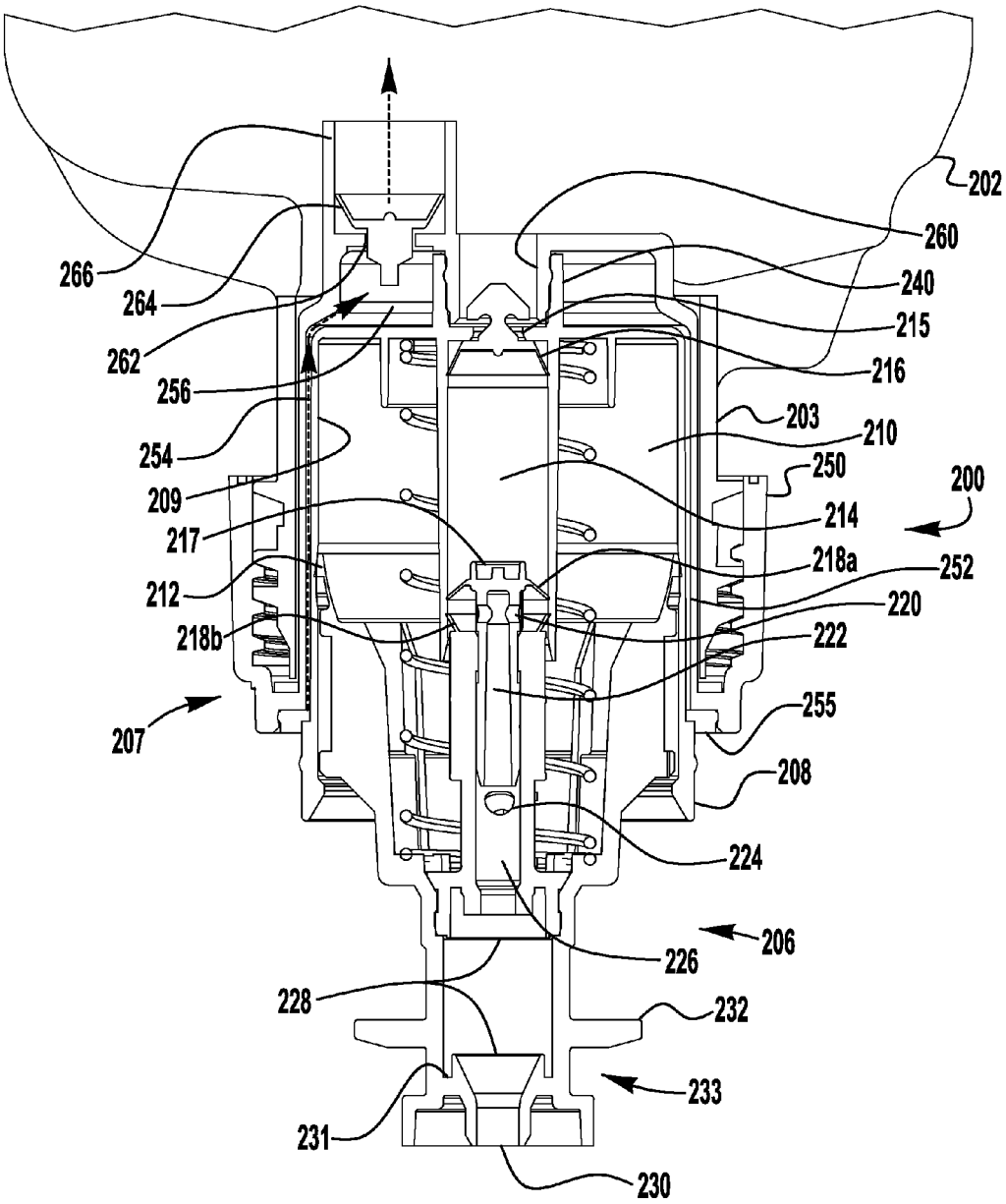
FIG. 2 is a partial cross-section of an exemplary embodiment of a refill unit with a pump with a venting assembly.
Figure 3:
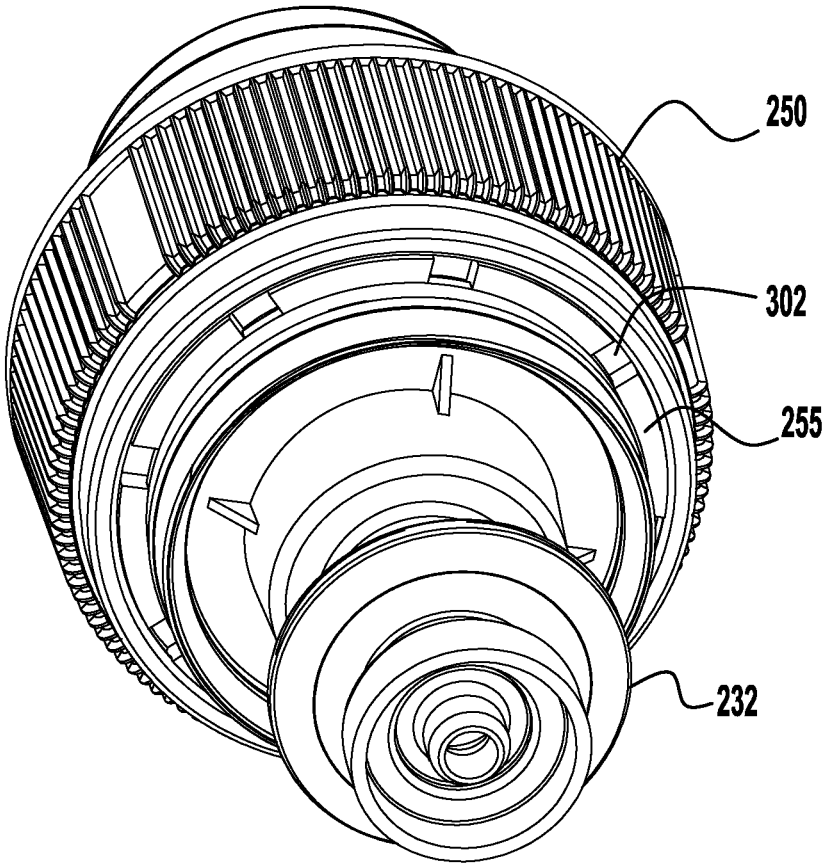
FIG. 3 is a prospective view of the pump and venting assembly of FIG. 2.

FIG. 2 is a partial cross-section of an exemplary embodiment of refill unit 200. Refill unit 200 includes a foam pump 206 and a venting insert 207. In some embodiments, foam pump 206 is an off-the-shelf non-venting pump, or a slightly modified off-the-shelf non-venting pump. FIG. 3 is a prospective view of the foam pump 206 and venting insert 207. Foam pump 206 includes a liquid pump chamber 218, a liquid inlet valve 216 and a liquid pump piston 217. Liquid inlet valve 216 may be any type of one-way valve, such as for example, a wiper valve, ball and spring valve, an umbrella valve, a flapper valve or the like. Liquid pump piston 217 moves up and down within liquid pump chamber 218. Liquid pump piston 217 includes a pair of opposed wiper seals 218*a*, 218*b*. In addition, liquid pump piston 217 has a hollow shaft and one or more apertures 220 between the opposed wiper seals 218*a*, 218*b* that allow liquid to flow from the liquid pump chamber 218 into the center of the liquid pump piston 217 toward outlet 230.

Foam pump 206 also includes an air pump chamber 210 and an air pump piston 211. Air pump piston 211 is connected to liquid pump piston 217 and accordingly, the two pistons 211, 217 move together. Air pump piston 211 includes a wiper seal 212 that rides against a wall of air pump chamber 210 to compress air. Liquid pump piston 217 includes one or more air inlet apertures 224. Foam pump 206 includes a mix media, such as for example screens 228, that cause liquid flowing from foamable liquid container 202 through liquid pump piston 217 and air flowing from air pump chamber 210 through aperture 224 to mix together to form a rich foam. Other mix media, such as, for example, a porous member, one or more sponges, a plurality of baffles, or the like, may be used.

In addition, located within outlet 230 is a drip catching channel 231. Drip catching channel 231 catches residual fluid and prevents the residual fluid from dripping out of the dispenser after a dispense event. In addition, the nozzle 233 of foam pump 206 includes an annular projection 232 for connecting to an actuator to move nozzle 233 upward to dispense foam and downward to recharge the air pump chamber 210 and liquid pump chamber 214. Air pump chamber 210 is recharged by drawing in air through the nozzle 233 and air outlet aperture 224. Drawing air in through the nozzle 233 also sucks back residual foam and fluid to help prevent dripping after dispensing a dose of foam.

Foam pump 206 includes guide ring 255 that includes one or more apertures 302 (FIG. 3) to allow air to flow up passage 254 formed between the outside of pump housing 208 and the interior of wall 252 of venting insert 207. In addition, foam pump 206 includes an annular projection 240 having notches and groves for securing foam pump 206 to venting insert 207. In some embodiments, the venting insert 207 includes one or more ribs (not shown) to ensure a plurality of air passages 254 are open between the venting insert 207 and the foam pump housing 208.

Venting insert 207 includes a housing 209. Housing 209 includes an annular projection 260 with mating notches or grooves for connecting to the annular projection 240 of foam pump 206. Any type of connection may be used to secure foam pump 206 to venting insert 207, such as, for example, a friction fit connection, a threaded connection, or the like.

Venting insert 207 includes a collar 250 secured to the housing 209 that connects to the neck 203 of container 202. Collar 250 may connect to neck 203 of container 202 in any manner such as for example a threaded connection, a snap fit connection, a friction fit connection or the like.

Housing 209 includes an air vent inlet aperture 262 located at least partially within container 202. A one-way air inlet valve 264 having a wiper seal is located proximate the aperture 262 to allow air to vent container 202 and prevent liquid from exiting container 202 through aperture 262. In addition, housing 209 includes a second annular projection or shroud 266. Shroud 266 may be extended to any suitable length. In some embodiments, shroud 266 is sized so that air entering non-collapsing container 202 is not drawn into liquid pump chamber 214 through aperture 215 which is proximate liquid inlet valve 216 when the liquid pump chamber 210 is being primed.

During operation, as piston 217 moves downward to the position shown in FIG. 2, liquid flows from the container 202 past one-way liquid inlet valve 216 into liquid pump chamber 214. As air pump chamber 210 expands, air is drawn in through outlet 230 into air pump chamber 210.

During downward movement, vacuum pressure builds up in container 202 due to the liquid being drawn into liquid pump chamber 214. Once the vacuum pressure becomes greater than the cracking pressure of the air inlet valve 264, air flows in through openings 302, through the passage 254 located between the inside of wall 252 of venting insert 207 and the outside wall 208 of foam pump 206, past air inlet valve 264 and into the container 202. Once the vacuum pressure drops the air inlet valve 264 creates a seal that prevents liquid from flowing out of container 202.

When foam pump 120 moves upward from the position shown in FIG. 2, liquid in liquid pump chamber 214 flows past wiper seal 218*a* through the one or more apertures 220 and toward outlet 230. Simultaneously, air flows from air pump chamber 210 through one or more apertures 224 where it mixes with the liquid flowing through liquid pump piston 217. The liquid and air mixture is forced through screens 228 and out of outlet 230. The turbulence in the liquid and air mixture caused by the screens 228 creates a rich foam.

Figure 4:
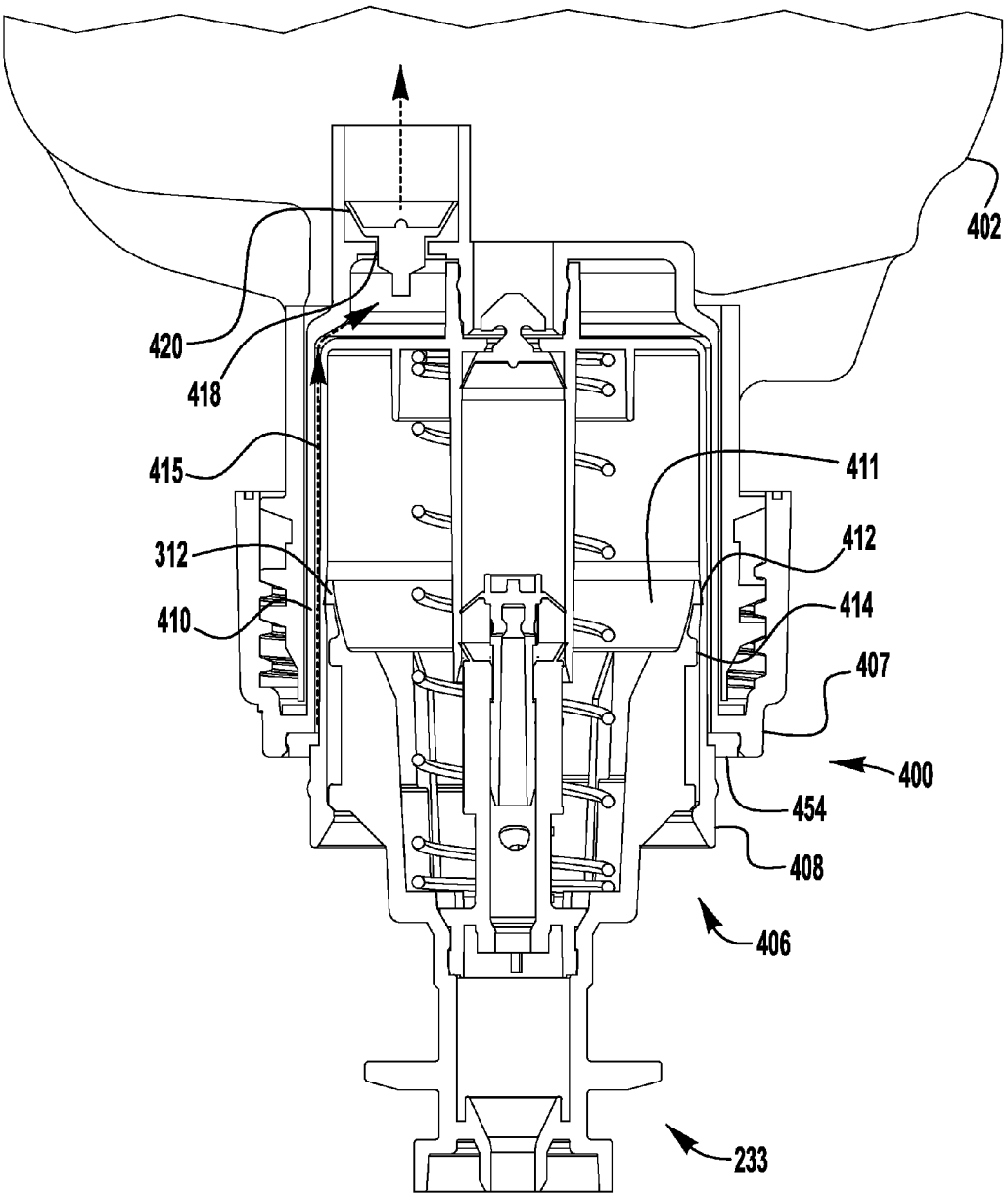
FIGS. 4 and 5 are partial cross-sections of another exemplary embodiment of a refill unit with a pump with a venting assembly.
Figure 5:
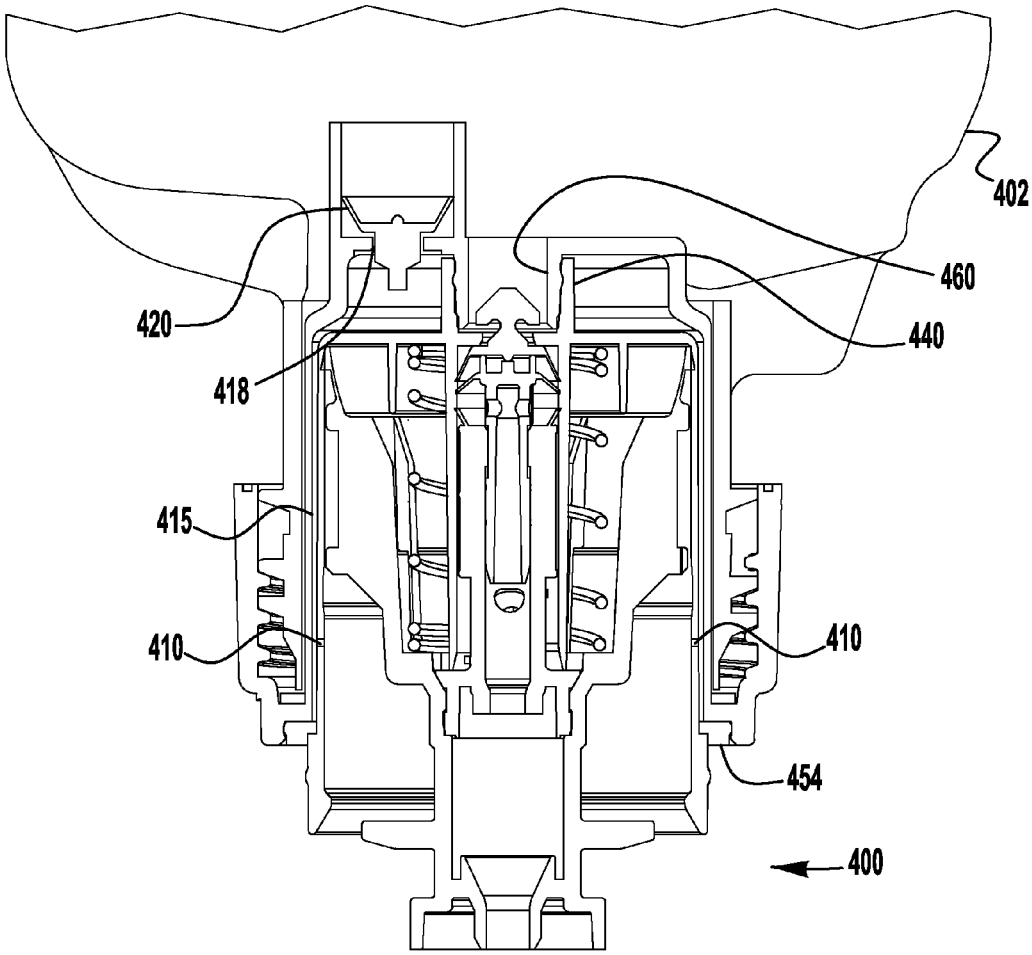

FIGS. 4 and 5 are partial cross-sections of another exemplary embodiment of a refill unit 400. Refill unit 400 includes a foam pump 408. Foam pump 408 is similar to foam pump 208 and like components are not renumbered and described with respect to FIGS. 4 and 5. The housing 408 of foam pump 506 includes one or more apertures 410. Preferably, the one or more apertures 410 are located so that when nozzle 233 is located in its downward most position (shown in FIG. 4) the one or more apertures 410 are located between the upper lobe 412 and the lower lobe 414 of wiper seal 411. Accordingly, the one or more apertures 410 are sealed off from the atmosphere when foam pump 406 is in its rest position. Foam pump 454 also includes sealing projection 454 which seals against venting insert 407. An air passage 415 is formed between the outside of housing 408 and the inside wall of venting insert 407, and is sealed off from the atmosphere by sealing projection 454 and by wiper seal 411 (when wiper seal 411 is in the position shown in FIG. 4).

When the nozzle 233 is moved upward during operation to dispense foam, wiper seal 411 moves up into air pump chamber allowing air passage 415 to be open to the atmosphere through one or more apertures 410. Once the vacuum pressure in container 402 is greater than the cracking pressure of one-way air inlet valve 420, air flows through one or more apertures 410, through air passage 415 through aperture 418 and past one-way air inlet valve 420 and into container 402. When the vacuum pressure drops or wiper seal 411 travels back to its rest position sealing off one or more apertures 410 air stops flowing into container 402 and liquid is prevented from flowing into the air passage 415 by one-way air inlet valve 420. In addition, of some liquid does bypass one-way air inlet valve 420, during shipping or mishandling, it is prevented from leaking by wiper seal 411.

Figure 6:
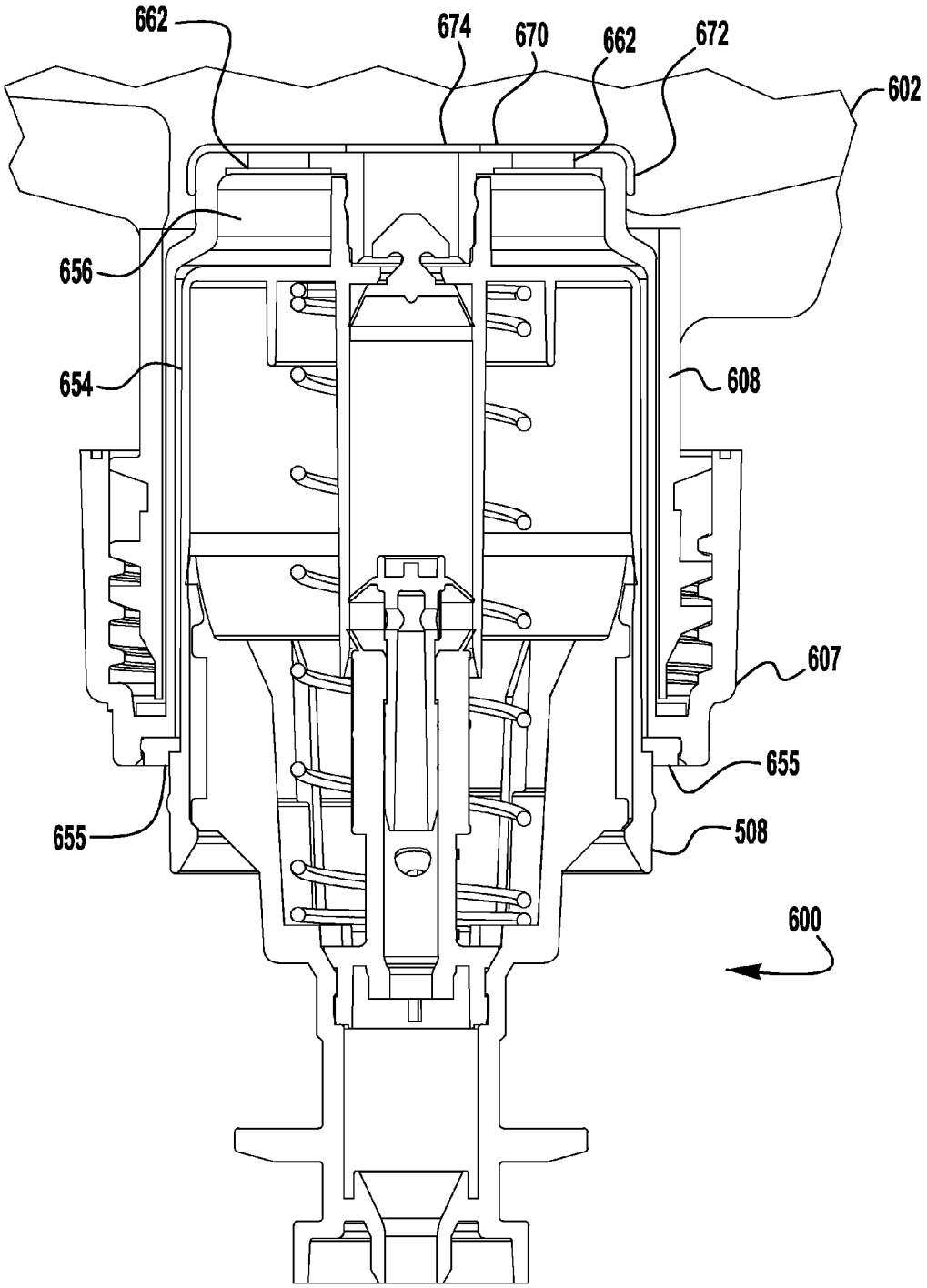
FIG. 6 is a partial cross-section of another exemplary embodiment of a refill unit with a pump and a venting assembly.

FIG. 6 is a partial cross-section of another exemplary embodiment of a refill unit 600. Refill unit 600 is similar to refill unit 200 and like parts are not renumbered and re-described with respect to FIG. 6. The inlet valve 264, however, has been replaced by a diaphragm 670. The upper portion of housing 608 includes one or more apertures 662. A diaphragm 670 is donut shaped with an aperture 674 located in the center. Diaphragm 670 covers and seals the one or more air inlet apertures 662 preventing liquid from flowing through the one or more apertures 662. When the vacuum pressure in container 602 becomes great enough air may be drawn up through apertures (not shown) in guide ring 655, through air passage 654, into air chamber 656 through one or more apertures 662 and past diaphragm valve 670 which lifts off of the one or more apertures 62 under vacuum pressure to allow air to vent container 602.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A refill unit for a soap, sanitizer or lotion comprising:
- a non-collapsing inverted container;
- the non-collapsing inverted container having a neck located at the bottom of the container;
- a pump secured to the neck;
- the pump having a housing;
- the housing having a cylindrical outside surface;
- the housing having an attachment mechanism for attaching the pump to a venting insert;
- the venting insert having a cylindrical inside surface and a cylindrical outside surface;
- at least a portion of the venting insert is located within the neck;
- air passage is located between the pump housing and the cylindrical inside surface of the venting insert;
- the venting insert includes one or more apertures therethrough;
- a one-way air inlet valve is located proximate the one or more apertures;
- the one-way air inlet valve opens when the vacuum pressure in the container exceeds the cracking pressure of the one-way air inlet valve to allow air to vent the container.

2. The refill unit of claim 1 wherein the venting insert includes a central opening for allowing liquid to flow into a liquid pump chamber.

3. The refill unit of claim 1 wherein the pump is a foam pump and includes both a liquid pump chamber and an air pump chamber.

4. The refill unit of claim 3 further comprising an aperture through a wall of the pump housing.

5. The refill unit of claim 4 wherein a wiper seal of the foam pump seals off the aperture when the foam pump is in its rest position.

6. The refill unit of claim 1 wherein the one-way air inlet valve is a diaphragm valve.

7. The refill unit of claim 1 wherein the one-way air inlet valve comprises a wiper seal.

8. The refill unit of claim 7 further comprising a shroud at least partially surrounding the one-way air inlet valve.

9. The refill unit of claim 1 wherein the pump housing includes a guide ring, and wherein the guide ring includes one or more openings for allowing air to flow through.

10. The refill unit of claim 1 further comprising a sealing member to seal between the pump and the venting insert.

11. A refill unit for a soap, sanitizer or lotion comprising:
- a non-collapsing container;
- the non-collapsing having a neck located at the bottom of the container;
- a foam pump secured to the neck;
- the foam pump having a housing;
- the housing having a cylindrical inside surface and a cylindrical outside surface;

an air piston movable back and forth within in the housing;

a sealing member of the air piston in contact with the cylindrical inside surface;

a venting insert having an inside cylindrical surface and an outside cylindrical surface;

the outside cylindrical surface of the venting insert located at least partially within the neck;

at least a portion of the outside cylindrical surface of the housing extending along at least a portion of the cylindrical inside surface of the venting insert;

an air passage located between the cylindrical outside surface of the housing and the cylindrical inside surface of the venting insert;

an aperture located through the venting insert to allow air to pass from a first side of the venting insert to the inside of the non-collapsing container; and a one-way valve located proximate the aperture.

12. The refill unit of claim 11 wherein the venting insert further comprises a collar.

13. The refill unit of claim 11 wherein the one-way valve is a diaphragm.

14. The refill unit of claim 11 wherein the one-way valve has a wiper seal.

15. The refill unit of claim 11 further comprising one or more apertures located in the housing that form a passage from the air passage to the atmosphere.

16. The refill unit of claim 15 wherein the sealing member of the air piston seals the one or more apertures.

17. A refill unit for a soap, sanitizer or lotion comprising:

a non-collapsing container;

the non-collapsing container having a neck located at the bottom of the container;

a pump having a liquid pump chamber and an air pump chamber;

the air pump chamber having a housing;

the housing having an outside cylindrical surface;

a venting insert;

the venting insert located at least partially within the neck of the container;

an air passage located between the outside cylindrical surface of the housing and an inside surface of the venting insert;

an air vent chamber located above the air pump chamber and in fluid communication with the air passage;

an aperture located at least partially above the air vent chamber extending through the venting insert placing the air vent chamber in fluid communication with the inside of the non-collapsing container; and a one-way valve located proximate the aperture for allowing air into the container and preventing liquid from flowing out of the container.

18. The refill unit of claim 17 further comprising a guide ring having one or more passages for ambient air to flow into the air passage.

19. The refill unit of claim 17 further comprising one or more apertures through the air pump chamber.

20. The refill unit of claim 19 further comprising an air pump wiper seal that intermittently seals the one or more apertures through the air pump chamber.

21. A venting insert comprising:

a cylindrical housing;

a closure for connecting the venting insert to a neck of a container;

the cylindrical housing having an upper side;

a first cylindrical projection extending downward from the upper side;

an aperture through the upper side and located within the first cylindrical projection;

a second aperture located in the upper side; and a one-way air inlet valve located proximate the second aperture.

* * * * *